US007260356B2

(12) United States Patent
Helstrom et al.

(10) Patent No.: US 7,260,356 B2
(45) Date of Patent: Aug. 21, 2007

(54) METHOD AND APPARATUS FOR WIRELESSLY COUPLING A SOURCE SIGNAL TO A RADIO FREQUENCY RECEIVER

(75) Inventors: Terry C. Helstrom, Boynton Beach, FL (US); Anh Nguyen, Boynton Beach, FL (US)

(73) Assignee: XM Satellite Radio, Inc., Washington, DC (US)

( * ) Notice: Subject to any disclaimer, the term of this patent is extended or adjusted under 35 U.S.C. 154(b) by 434 days.

(21) Appl. No.: 10/803,762

(22) Filed: Mar. 18, 2004

(65) Prior Publication Data

US 2005/0227612 A1 Oct. 13, 2005

(51) Int. Cl.
*H04H 1/00* (2006.01)

(52) U.S. Cl. ..... 455/3.02; 455/41.2; 455/3.06; 455/23

(58) Field of Classification Search ..... 455/3.01, 455/3.02, 3.06, 3.05, 428, 12.1, 13.1, 13.3, 455/11.1, 20, 23, 41.2, 41.3, 42, 517, 569.2, 455/66.1, 19, 152.1, 205, 277.1, 352, 280
See application file for complete search history.

(56) References Cited

U.S. PATENT DOCUMENTS 5,303,393 A * 4/1994 Noreen et al. ..... 455/3.02
5,333,155 A * 7/1994 Dambacher ..... 375/240
5,428,610 A * 6/1995 Davis ..... 370/312
6,272,328 B1 8/2001 Nguyen et al.
6,493,546 B2 12/2002 Patsiokas
6,563,805 B1 5/2003 Ma et al.
6,614,767 B1 9/2003 Marko et al.
2005/0107029 A1 * 5/2005 Walker et al. ..... 455/3.02

* cited by examiner

*Primary Examiner*—Edward F. Urban
*Assistant Examiner*—John J. Lee
(74) *Attorney, Agent, or Firm*—Pablo Meles; Akerman Senterfitt

(57) ABSTRACT

A digital audio system (20) can include a receiver (24) coupled to an RF modulator (30), a source signal modulated by the RF modulator to provide a modulated signal, and an external antenna (32) for receiving the source signal and for transmitting the modulated signal. The receiver can be a satellite radio receiver or any digital source such as an FM radio or MP3 player for example. The system can further include a coupling network (26) coupled between the receiver and the external antenna and between the RF modulator and the external antenna. The system can further include an internal antenna (34) coupled to the RF modulator for radiating the modulated signal via a second path. The digital audio system can be a satellite digital audio radio system for a vehicle 31 with the external antenna placed outside the vehicle and the internal antenna placed inside the vehicle.

18 Claims, 6 Drawing Sheets

3
SAT. ANTENNA
4
FM ANTENNA
7
2
ANTENNA MODULE
FM SWITCH
6
HEAD UNIT
8
9
Prior Art
1
SATELLITE RECEIVER
5
FM MODULATOR 10
13
EXTERNAL ANTENNA
Satellite Receive
FM Transmit
POWER SUPPLY
15
16
18
11
14
12

100

200

METHOD AND APPARATUS FOR WIRELESSLY COUPLING A SOURCE SIGNAL TO A RADIO FREQUENCY RECEIVER

CROSS-REFERENCE TO RELATED APPLICATIONS (Not applicable)

FIELD OF THE INVENTION

The invention relates generally to a method and apparatus for wirelessly providing a source signal to a radio frequency receiver, and more particularly to a method and apparatus for wirelessly providing a source signal to a radio frequency receiver in a vehicle.

BACKGROUND OF THE INVENTION

Satellite radio operators are providing digital radio broadcast services covering the entire continental United States. These services offer over 120 channels, of which nearly 50 channels in a typical configuration provides music with the remaining stations offering news, sports, talk and data channels. Briefly, the service provided by XM Satellite Radio includes a satellite X-band uplink to two satellites which provide frequency translation to the S-band for retransmission to radio receivers on earth within a coverage area. Radio frequency carriers from one of the satellites are also received by terrestrial repeaters. The content received at the repeaters is retransmitted at a different S-band carrier to the same radios that are within their respective coverage areas. These terrestrial repeaters facilitate reliable reception in geographic areas where LOS reception from the satellites is obscured by tall buildings, hills, tunnels and other obstructions. The signals transmitted by the satellites and the repeaters are received by SDARS receivers which can be located in automobiles, in handheld or in stationary units for home or office use. The SDARS receivers are designed to receive one or both of the satellite signals and the signals from the terrestrial repeaters and combine or select one of the signals as the receiver output.

Existing FM radio receivers or other customized FM radio receivers can be retrofitted to receive the satellite digital radio broadcast and enable one to listen to the programming via an unused FM frequency using an RF modulator. As shown in FIG. 1, an audio system 3 can include an FM modulator 5 that is connected to a head unit 6 (via an FM switch) and corresponding FM antenna 6 via a coaxial cable or transmission line 9 to enable a full frequency response. To receive the satellite digital audio radio transmission, the audio system 3 further requires a satellite antenna 4 and an antenna module 2 coupled to a satellite receiver 1 via another coaxial cable or transmission line 8. The required cabling in an automotive environment for such a set up as shown in FIG. 1 can be a little cumbersome and involve additional cost in terms additional wiring. Currently, satellite radios must either be permanently installed in vehicles or connected to a car stereo via the cassette deck. Permanent installation is costly and requires professional installation, which is unattractive to many consumers. Moreover, many vehicles do not have cassette decks. Thus, a need exists for a way to eliminate additional cabling when retrofitting or initially installing a radio system to receive a source signal such as a satellite digital audio radio signal or other digital source signal.

Furthermore, vehicles come in various configurations and various factory installed antenna arrangements. Since the Federal Communication Commission (FCC) requires that an FM modulated signal radiating a source signal must be below a predetermined power level, the effective arrangements for wirelessly re-broadcasting a source signal via an FM modulator are limited. There are currently no existing FM modulator arrangements that can effectively cover all the existing FM antenna arrangements for automobiles unless cumbersome cabling or wiring is used. For example, automobile FM receive antennas can be embedded in a front or rear windshield which can possibly receive a internally radiated FM modulated signal without cabling, but will likely fail to reach a common external FM receive antenna. If a externally radiated FM modulated signal is provided without cabling to a common external FM receive antenna, placement will be critical due to the low power requirements. In the scenario of a satellite digital audio radio system where an external satellite antenna is required, no existing FM modulation scheme is suitable for all existing arrangements of automobile FM receivers unless additional cabling is provided.

SUMMARY OF THE INVENTION

In a first embodiment in accordance with the present invention, a digital audio system can include a receiver coupled to a radio frequency (RF) modulator, a source signal modulated by the radio frequency modulator to provide a modulated signal, and an external antenna for receiving the source signal and for transmitting the modulated signal. The receiver can be a satellite radio receiver and the RF modulator can be an FM RF modulator although the receiver can essentially be any digital source such as a digital FM radio receiver or an MP3 player for example. The system can further include a coupling network coupled between the receiver and the external antenna and between the radio frequency modulator and the external antenna. The coupling network can create a short circuit for satellite signals received and FM radio frequencies transmitted and an open circuit for FM radio frequencies received and satellite signals transmitted. The system can further include an internal antenna coupled to the radio frequency modulator for radiating the modulated signal via a second path. The digital audio system can be a satellite digital audio radio system for a vehicle with the external antenna placed outside the vehicle and the internal antenna placed inside the vehicle.

In a second embodiment, a satellite digital audio radio system can include a satellite receiver coupled to a radio frequency modulator, an external antenna for receiving a satellite source signal and for transmitting a modulated signal, and a coupling network coupled between the satellite receiver and the external antenna and between the radio frequency modulator and the external antenna. The satellite digital audio radio system can also include an internal antenna coupled to the radio frequency modulator for radiating the modulated signal via a second path. Additionally, the digital audio system can further include a series of attenuators and low pass filters coupled to the radio frequency modulator and a splitter for splitting the modulated signal between a first path toward the external antenna and the second path toward the internal antenna.

In a third embodiment, a method of wirelessly coupling a source signal to a radio frequency receiver in a vehicle can include the steps of modulating the source signal to provide a modulated signal and splitting the modulated signal between an external radiating element and an internal radiating element. The step of splitting the modulated signal can create isolation between the external radiating element and the internal radiating element. The method can further include the step of receiving the source signal and transmitting the modulated signal via the external radiating element. The method can also include the step of radiating the modulated signal via the external radiating element and the internal radiating element and receiving the modulated signal at an FM radio receiver.

DETAILED DESCRIPTION OF THE DRAWINGS

As previously mentioned, existing satellite radios must either be permanently installed in vehicles or connected to a car stereo via a cassette deck. Permanent installation is costly and requires professional installation, which is unattractive to many consumers. Moreover, many vehicles do not have cassette desks. A proposed solution by XM Radio can use an FM modulator that will enable its satellite radio programming to be transmitted on FM frequencies on radios inside of vehicles consistent with the requirements of the FCC's rules which have limitations on power of such transmissions. The FM modulator proposed herein presents a third option for consumers for receiving satellite radio inside of vehicles.

Section 15.203 of the FCC Commission's rules requires an intentional radiator, such as XM Radio's FM modulator, to be "designed to ensure that no antenna other than that furnished by the responsible party shall be used with the device. The use of a permanently attached antenna or of an antenna that uses a unique coupling to the intentional radiator shall be considered sufficient to comply with the provisions of this section." 47 C.F.R. § 15.203. The Commission adopted this requirement to prevent users from replacing the antenna provided with an intentional radiator with one that increases the strength of the radiated signal.

Figures 1, 2:
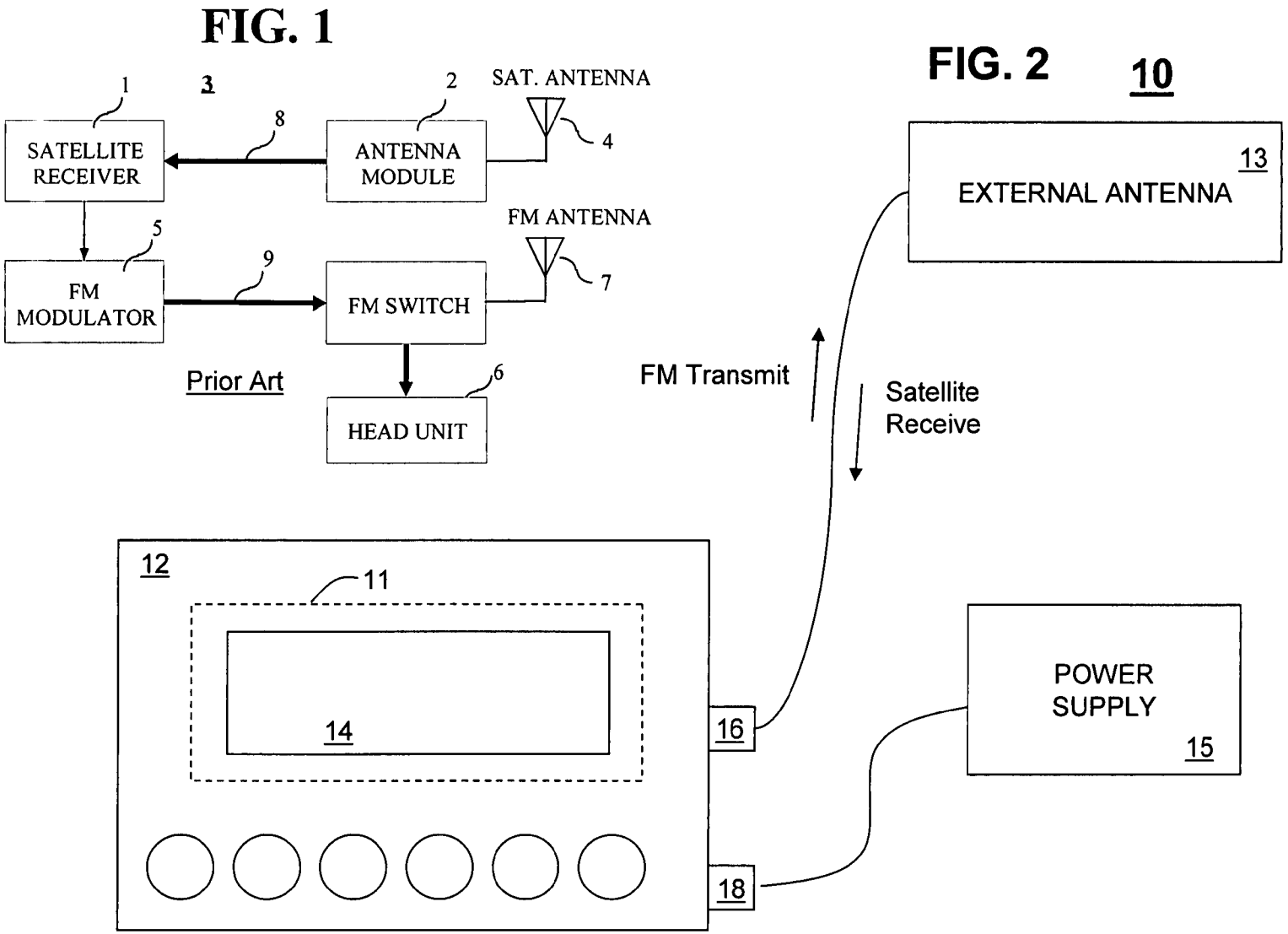
FIG. 1 is block diagram of an existing satellite digital audio radio receiver system.
FIG. 2 illustrates a satellite digital audio radio system using a single antenna to both radiate FM signals and receive satellite signals and an internal antenna that separately radiates FM signals in accordance with the present invention.

As depicted in one embodiment, the satellite digital audio radio system (SDARS) 10 of FIG. 2 includes an external antenna 13 used with XM Radio's FM modulator that serves as both an FM external radiating antenna and an SDARS receiving antenna. The wire from the antenna 13 can be connected to an XM Radio receiver unit 12 with a standard connector (SMB male) 16. The receiver unit 12 can convert the SDARS signal to an FM signal using an FM modulator (not shown in this embodiment). The receiver unit can include a display 14 and an FM splitter circuit which sends the FM signal to both an internal FM radiating antenna 11 and the external antenna 13 which also radiates the FM signal simultaneously. This arrangement provides optimum FM reception for any automobile FM antenna configuration without any additional cabling. The receiver unit can optionally include another connector 18 for connecting to a power source 15 such as the conventional cigarette lighter connection to an automobile battery.

Figure 3:
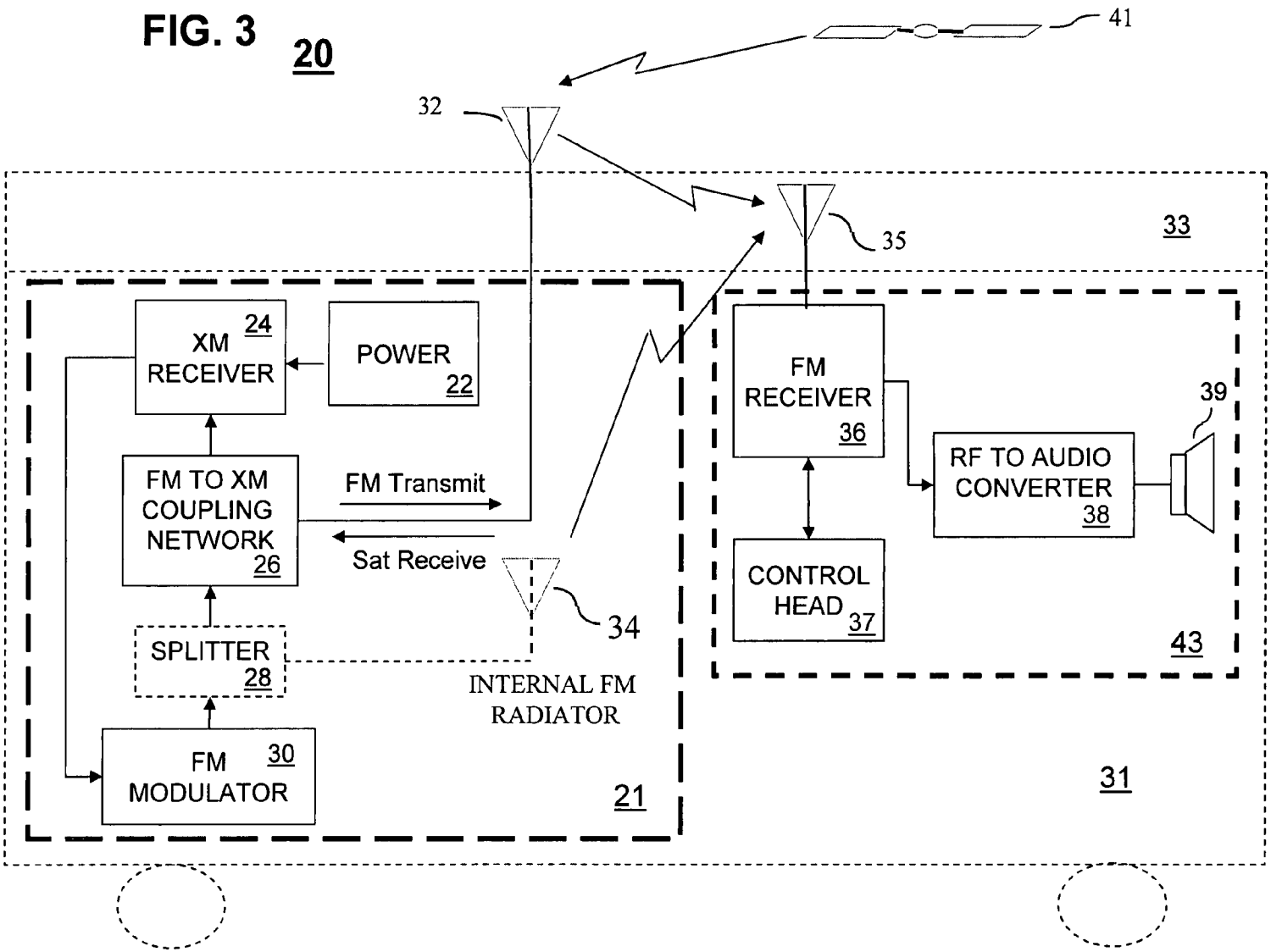
FIG. 3 is a block diagram illustrating another digital audio radio system similar to the system of FIG. 2 further including an FM receiver in accordance with the present invention.

Referring to FIG. 3, another SDARS system 20 is shown as used with a vehicle 31 including a satellite receiver unit 21 having an external antenna 32 (used with XM Radio's FM modulator 30) that serves as both an FM external radiating antenna and an SDARS receiving antenna for receiving satellite signals from at least one satellite 41. The FM modulator 30 can convert the SDARS signal to an FM signal. The wire from the antenna 32 can be coupled to a satellite receiver such as XM's Radio receiver unit 24 via an coupling network 26. As will be explained in further detail with-respect to FIG. 5, the coupling network 26 enables the use of a single antenna to both transmit FM signals and receive satellite signals. The receiver unit 21 can also optionally include an FM splitter circuit 28 which sends the FM signal to both an internal FM radiating antenna 34 and the external antenna 32 which radiates the FM signal simultaneously. The receiver unit 21 can be powered by a power source 22 which can be provided by the automobile 31 or otherwise. Note, the automobile 31 can come with a factory installed or after-market installed AM/FM radio 43 including an FM receiver 36, a control head 37, RF to audio converter 38, speakers 39 and an FM receive antenna 35. As previously noted, the FM receive antenna 35 is typically placed externally or embedded in glass 33 such as a front or rear windshield. In this arrangement, the satellite receiver unit 21 provides optimum FM reception for any automobile FM antenna configuration without any additional cabling.

Figure 4:
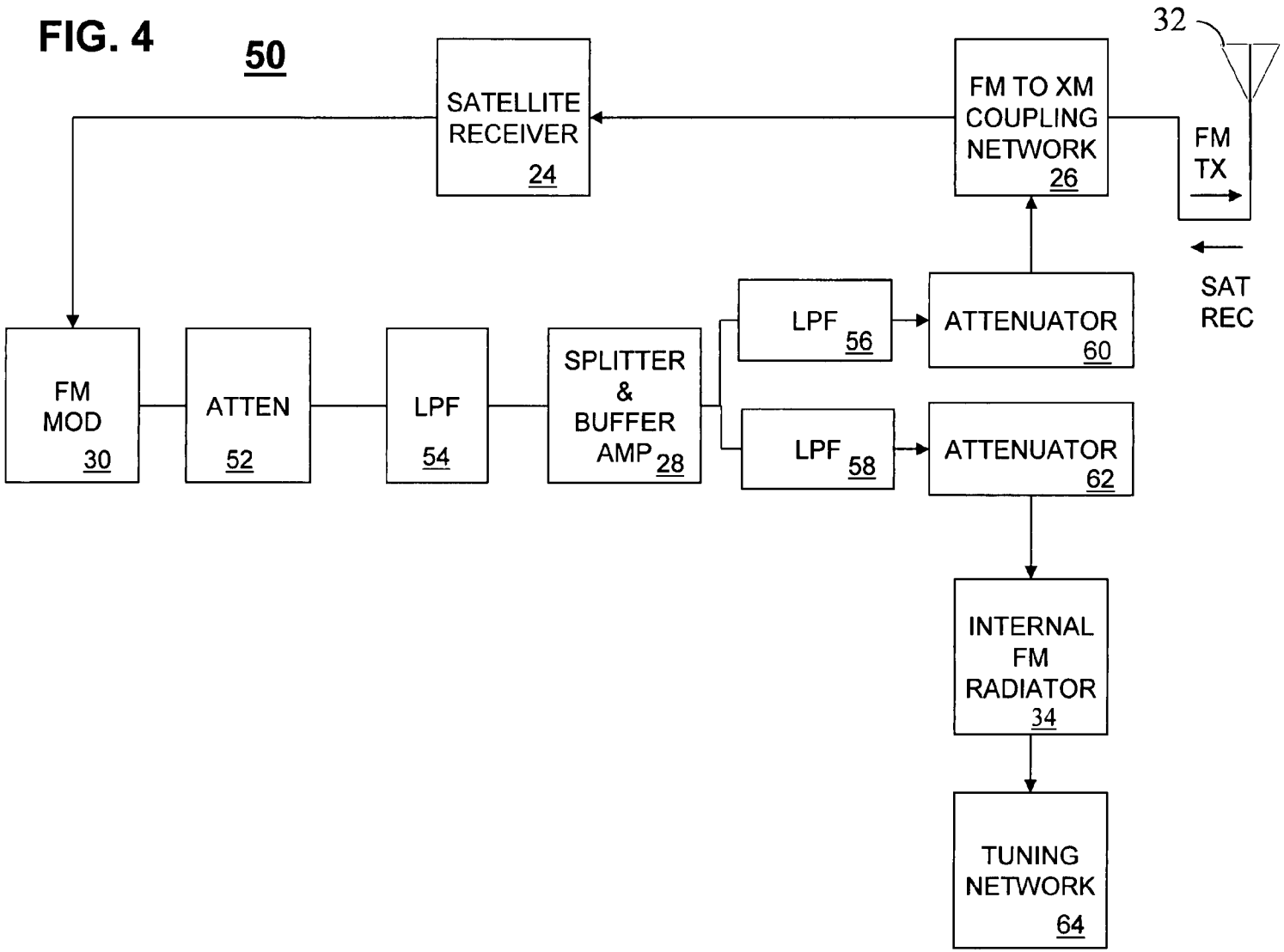
FIG. 4 is a block diagram of a satellite digital audio radio receiver system in accordance with the present invention.

Referring to FIG. 4, a satellite receiver system 50 in accordance with an embodiment of the present invention can include the satellite receiver 24 coupled to the radio frequency modulator 30 which can come in the form of an integrated circuit made by Rohm for example. The RF modulator 30 can be coupled to an attenuator 52 and a harmonic or low pass filter 54. The output from the filter 54 can serve as an input to an optional splitter and buffer amplifier 28 which creates adequate isolation between two radiating elements (32 and 34). One output from the splitter and buffer amplifier 28 is further filtered and attenuated by low pass filter 56 and attenuator 60 respectively before being fed back to the coupling network 26 which enables the antenna or radiating element 32 to serve as both an FM transmit path and a satellite receive path as will be further explained with regard to FIG. 5. Another output from the splitter and buffer amplifier 28 is filtered and attenuated by low pass filter 58 and attenuator 62 respectively before the signal is radiated via an internal FM radiator or antenna 34. The radiator may also feed into a tuning network 64 that can selectively tune the frequencies being transmitted, for example, to one among 6 selectable frequencies within the 107 to 108 MHz range or 6 frequencies within the 88 to 89 MHz range.

Figure 5:
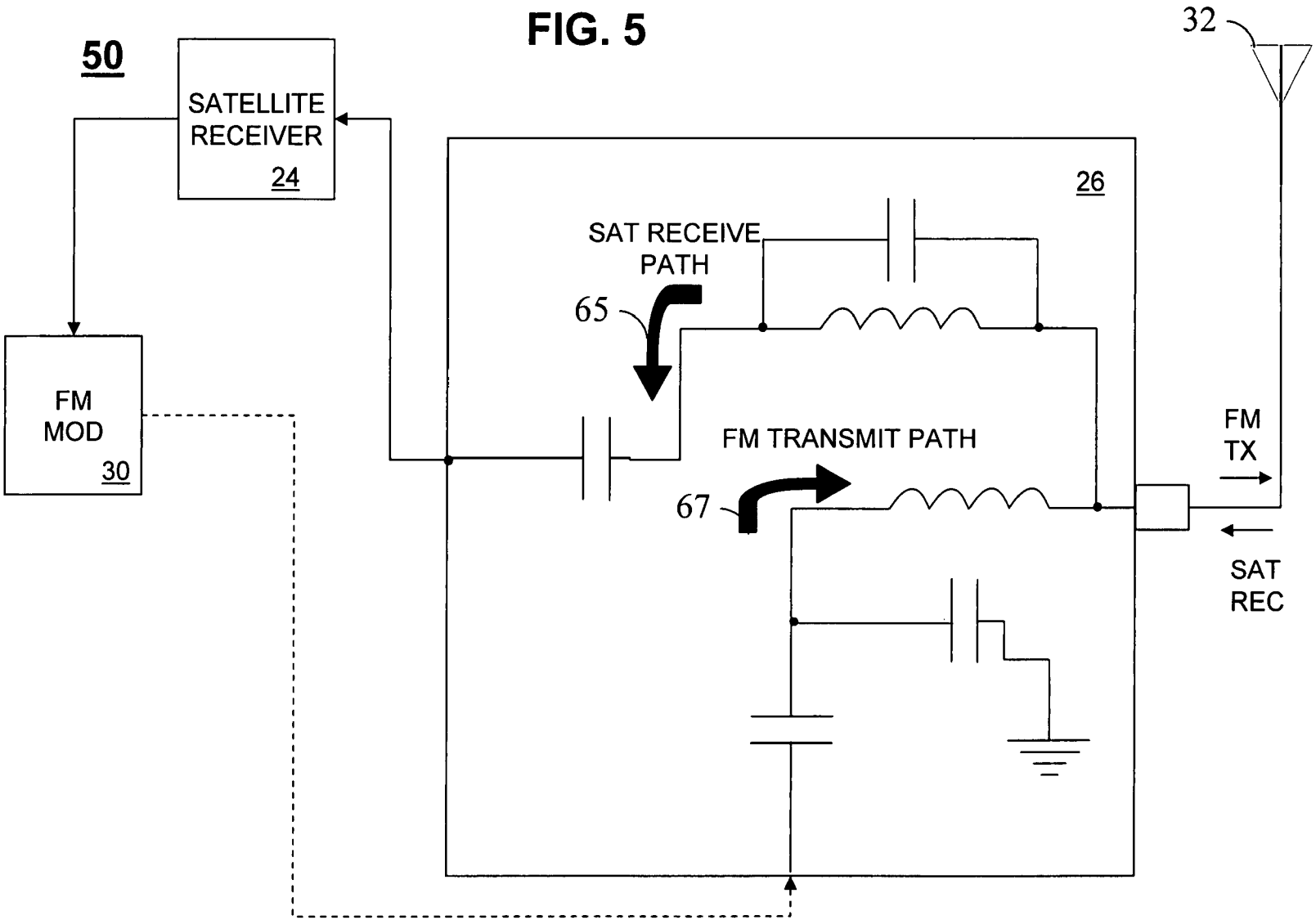
FIG. 5 is a block diagram of the satellite receiver of FIG. 4 further detailing the coupling network in accordance with the present invention.

Referring to FIG. 5, the satellite receiver system 50 is shown once again including the satellite receiver 24, the radio frequency modulator 30 and the coupling network 26 in greater detail. As shown, the inductor and capacitor values for the components shown are provided such that the satellite receive path 65 is seen as a short circuit for satellite signals in the S Band and an open circuit for FM received signal. Similarly, the inductor and capacitor values for the components on the FM transmit path 67 create essentially a short circuit for FM transmit signals and an open circuit for satellite signals in the S Band.

Figure 6:
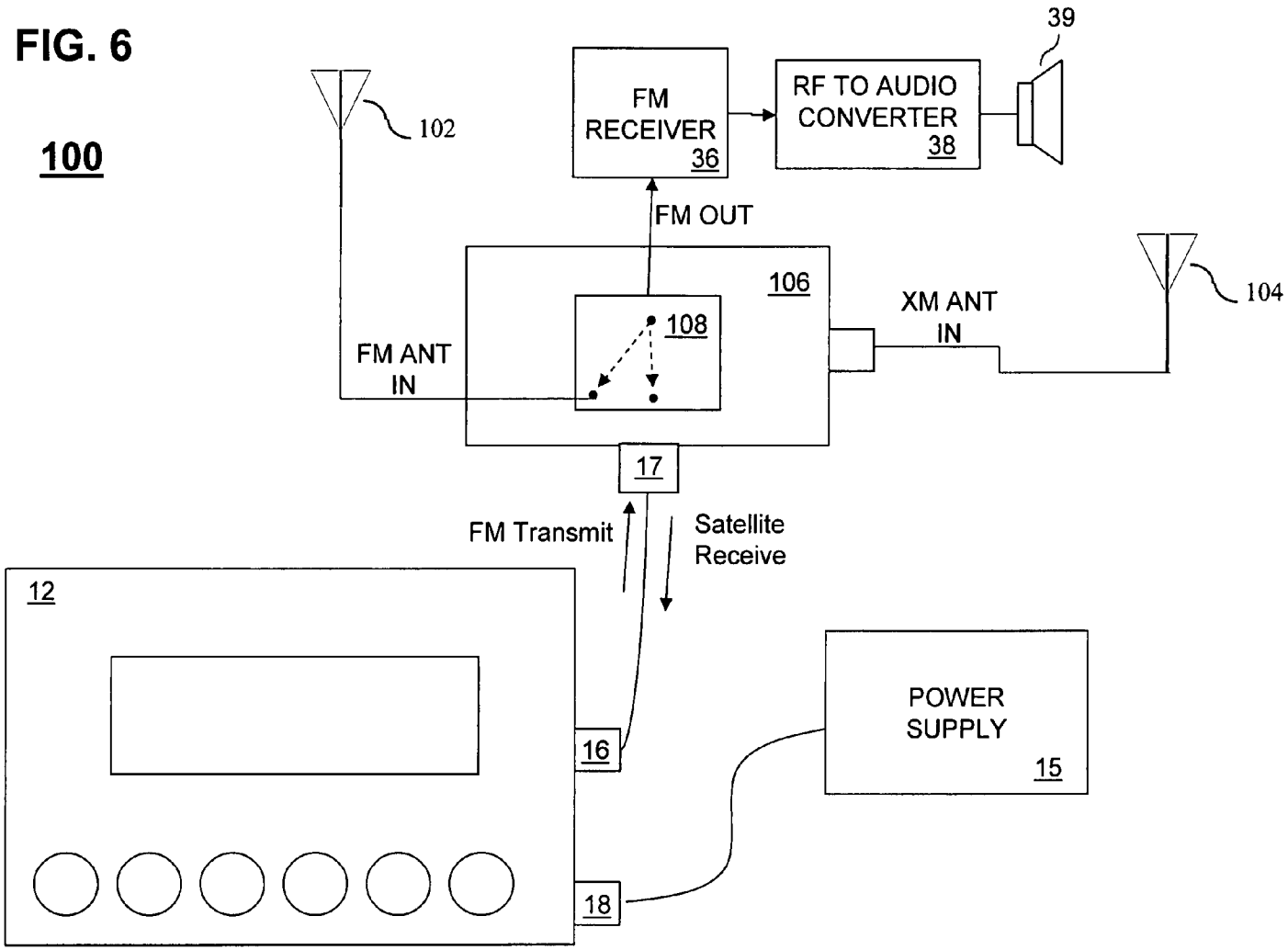
FIG. 6 is a block diagram of a satellite digital audio receiver system using an FM direct adaptor in accordance with an embodiment of the present invention.

In yet another embodiment as shown in FIG. 6, a satellite digital audio radio system 100 includes the receiver unit 12 with the standard connectors (SMB male) 16 and 18 as previously shown in FIG. 2 now coupled to an FM direct adaptor 106 and the power supply 15. The adaptor 106 enables a wired version of the prior embodiments while still taking advantage of the single path for both FM transmit and satellite receive signals. The adaptor 106 allows RF modulated signals of source signals (such as XM Radio's satellite signals) to be converted to audio via a conventional factory installed or after-market installed AM/FM radio having the FM receiver 36, RF to audio converter 38, and speaker(s) 39. The FM direct adaptor 106 can include an input for an FM receive antenna 102, an input for a satellite receive antenna 104 and another port 17 that receives the modulated transmit signal from the receiver unit 12. Note that the same port 17 that receives the modulated transmit signal also serves as an output port from the adaptor as part of the satellite receive path from the antenna 104 to the connector 16 of the receiver unit 12. Finally, the adaptor 106 also includes an output that provides FM signals (either from conventional FM receive antenna 102 or from the FM modulated signal from FM modulator (not shown) of the receiver unit 12) to the FM receiver 36.

Operationally, the FM direct adaptor 106 includes a switching mechanism 108 that allows the FM receiver 36 to receive conventional FM radio signals via antenna 102 in a first mode and also directly receive FM modulated signals from the FM modulator (not shown) of the receiver unit 12 in a second mode. Furthermore, in the second mode, the antenna 104 receives satellite signals and a satellite receive path is created through port 17 of the adaptor 106. The received satellite signal is FM modulated by the FM modulator in the receiver unit 12 and then transmitted out through the same transmission line and port 17 as previously described.

Figure 7:
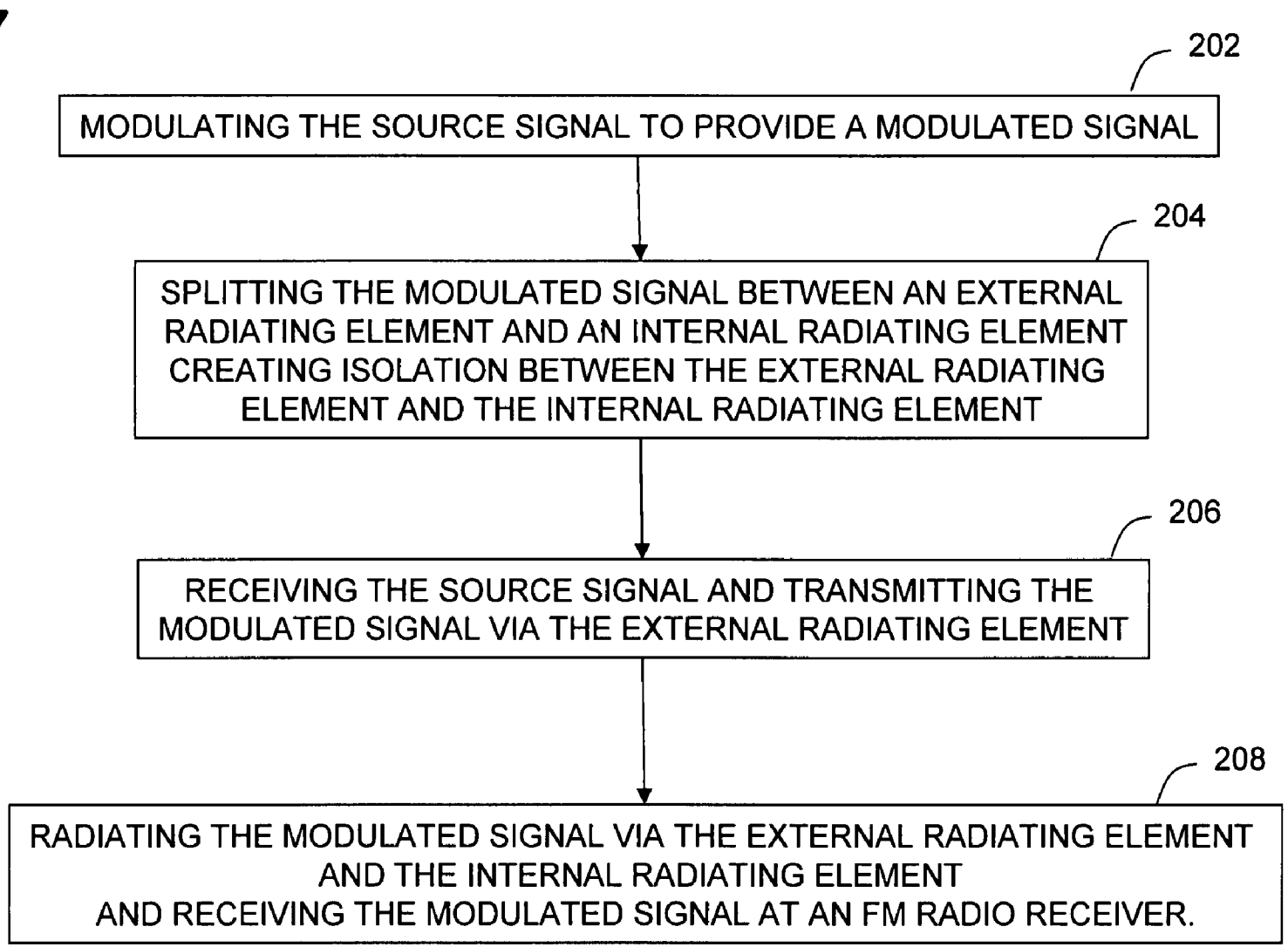
FIG. 7 is a flowchart illustrating a method in accordance with the present invention.

Referring to FIG. 7, flow chart of a method 200 of wirelessly coupling a source signal to a radio frequency receiver in a vehicle is shown. The method 200 can include the steps of modulating the source signal to provide a modulated signal at step 202 and splitting the modulated signal between an external radiating element and an internal radiating element at step 204. The step of splitting the modulated signal can create isolation between the external radiating element and the internal radiating element. The method can further include the step 206 of receiving the source signal and transmitting the modulated signal via the external radiating element. The method can also include the step 208 of radiating the modulated signal via the external radiating element and the internal radiating element and receiving the modulated signal at an FM radio receiver.

The description above is intended by way of example only and is not intended to limit the present invention in any way except as set forth in the following claims.

We claim:

1. A digital audio system, comprising:

a receiver coupled to a radio frequency modulator;

a source signal modulated by the radio frequency modulator to provide a modulated signal;

an external antenna for receiving the source signal and for transmitting the modulated signal; and a series of attenuators and low pass filters coupled to the radio frequency modulator and a splitter for splitting the modulated signal between a first path toward the external antenna and a second path toward an internal antenna coupled to the radio frequency modulator.

2. The digital audio system of claim 1, wherein the receiver is a satellite radio receiver and the radio frequency modulator is an FM radio frequency modulator.

3. The digital audio system of claim 1, wherein the digital audio system further comprises a coupling network coupled between the receiver and the external antenna and between the radio frequency modulator and the external antenna.

4. The digital audio system of claim 3, wherein the coupling network creates a short circuit for higher frequencies received and lower frequencies transmitted and an open circuit for lower frequencies received and higher frequencies transmitted.

5. The digital audio system of claim 4, wherein the coupling network creates the short circuit for satellite signals received and FM radio frequencies transmitted and the open circuit for FM radio frequencies received and satellite signals transmitted.

6. The digital audio system of claim 1, wherein the digital audio system further comprises the internal antenna coupled to the radio frequency modulator for radiating the modulated signal via the second path.

7. The digital audio system of claim 6, wherein the digital audio system further comprises a tuning network for tuning the modulated signal coming from the internal antenna.

8. The digital audio system of claim 6, wherein the digital audio system is a satellite digital audio radio system for a vehicle wherein the external antenna is placed outside the vehicle and the internal antenna is placed inside the vehicle.

9. The digital audio system of claim 1, wherein the receiver is selected from the group comprising a satellite digital audio radio, an MP3 player, a digital FM radio receiver, and a digital AM receiver.

10. A satellite digital audio radio system, comprising:

a satellite receiver coupled to a radio frequency modulator;

an external antenna for receiving a satellite source signal and for transmitting a modulated signal;

a coupling network coupled between the satellite receiver and the external antenna and between the radio frequency modulator and the external antenna; and a series of attenuators and low pass filters coupled to the radio frequency modulator and a splitter for splitting the modulated signal between a first path toward the external antenna end a second path toward an internal antenna coupled to the radio frequency modulator.

11. The satellite digital audio radio system of claim 10, wherein the coupling network creates a short circuit for satellite signals received and FM radio frequencies transmitted and an open circuit for FM radio frequencies received and satellite signals transmitted.

12. The satellite digital audio radio system of claim 10, wherein the satellite digital audio radio system further comprises the internal antenna coupled to the radio frequency modulator for radiating the modulated signal via the second path.

13. The satellite digital audio radio system of claim 12, wherein the satellite digital audio radio system further comprises a tuning network for tuning the modulated signal coming from the internal antenna.

14. The satellite digital audio radio system of claim 12, wherein the satellite digital audio radio system is for a vehicle wherein the external antenna is placed outside the vehicle and the internal antenna is placed inside the vehicle.

15. A method of wirelessly coupling a source signal to a radio frequency receiver in a vehicle, comprising the steps of:

modulating the source signal to provide a modulated signal;

attenuating the modulated signal using a series of attenuators coupled to a radio frequency modulator providing the modulated signal;

low pass filtering using a series of low pass filters coupled to the radio frequency modulator; and splitting using a splitter for spitting the modulated signal between a first path toward an external radiating element and a second path toward an internal radiating element.

16. The method of claim 15, wherein the step of splitting the modulated signal comprises creating isolation between the external radiating element and the internal radiating element.

17. The method of claim 15, wherein the method further comprises the step of receiving the source signal and transmitting the modulated signal via the external radiating element.

18. The method of claim 15, wherein the method further comprises radiating the modulated signal via the external radiating element and the internal radiating element and receiving the modulated signal at an FM radio receiver.

* * * * *